United States Patent [19]

Shipes

[11] 4,095,648

[45] Jun. 20, 1978

[54] TUBE BUNDLES

[75] Inventor: Kelly V. Shipes, Houston, Tex.

[73] Assignee: Hudson Products Corporation, Houston, Tex.

[21] Appl. No.: 701,624

[22] Filed: Jul. 1, 1976

[51] Int. Cl.[2] ..... F28F 1/36; F28F 9/00

[52] U.S. Cl. ..... 165/162; 165/172; 165/178; 248/68 R

[58] Field of Search ..... 165/DIG. 13, 172, 178, 165/162; 248/68 R

[56] References Cited

U.S. PATENT DOCUMENTS

| | | | |
|---|---|---|---|
| 1,704,097 | 3/1929 | Muhleisen | 165/162 |
| 1,907,867 | 5/1933 | Potter | 165/172 |
| 2,362,694 | 11/1944 | Hill | 165/162 |
| 2,402,209 | 6/1946 | Ryder | 165/172 |
| 2,440,803 | 5/1948 | Lea | 165/172 |
| 2,775,433 | 12/1956 | Matheny | 165/172 |
| 2,862,693 | 12/1958 | Tinker | 165/162 |
| 2,868,515 | 1/1959 | Garland | 165/172 |
| 2,970,814 | 2/1961 | Floreen | 165/172 |
| 3,720,259 | 3/1973 | Fritz et al. | 165/162 |
| 3,998,268 | 12/1976 | Sagan | 165/172 |

*Primary Examiner*—Charles J. Myhre
*Assistant Examiner*—Sheldon Richter

[57] ABSTRACT

There is disclosed a tube bundle wherein adjacent finned tubes of adjacent rows of tubes are arranged in triangular patterns and supported in fixed spaced relation to one another by rigid strips extending beneath each row and having arcuate surfaces on their upper and lower sides which are received in annular recesses formed in each tube of the rows above and beneath them, respectively.

17 Claims, 4 Drawing Figures

2
2
10
17
20
12A
19A
12
19B
12B
13
21
12C
19C
11
19D
12D
15
12E
19E
12F
19F
16

10
11
14
17
20
12A
12B
19A
19B
12D
19C
19D
21
12F
19E
19F
13
16
15

TUBE BUNDLES

This invention relates to tube bundles for heat exchangers in which parallel rows of elongate, finned tubes extend generally horizontally between headers at their opposite ends, whereby a first fluid medium may be circulated through the tubes in indirect heat exchanger relation with air which is caused to pass over the outside of the tubes. More particularly, it relates to improvements in tube bundles of this type in which the axes of adjacent tubes of adjacent rows are arranged in triangular patterns and supported in fixed spaced relation to one another by strips of rigid material which extend beneath each row and which are curved along their upper sides to fit closely about portions of the tubes in the rows above them and along their lower side to fit closely about portions of the tubes in the rows beneath them, the lowermost strips being supported by the frame on which the bundle is mounted.

It is important to maintain a fixed spacing between the tubes in order to insure a predetermined air flow velocity within the free area between them and thus obtain the desired heat transfer effectiveness. Furthermore, disposal of the strips at relatively short intervals along the lengths of the tubes reduces their tendancy to sag, and thus not only reduces undesirable stresses in the tubes, but also prevents low spots in which condensate might accumulate.

The use of the aforementioned strips has not been entirely satisfactory, because, for one thing, the ends of the fins on which the strips are supported are so weak that, in order to prevent their collapse, which would alter the spacing of the tubes, it is necessary to use relatively wide strips having large supporting areas and/or to use the strips at short intervals. In either case, the strips may severely limit the free area through which fluid may pass through the bundles.

Also, to counteract their tendency to migrate along the lengths of the tubes, especially during transport, or during use in environments subject to considerable vibration, the ends of the strips must often be confined in openings in the side members of the frame member. Even when this is done, the strips are so long that they may flex or bend into a shape which frees their ends, and when this occurs, the strips are free to migrate along the lengths of the tubes, and thus no longer support the tubes at regular intervals along their lengths.

It has also been proposed to support the tubes by means of metal rings cast about each tube to a diameter somewhat greater than that of the fins, so that the rings on adjacent tubes in adjacent rows may engage one another to maintain the spacing therebetween. However, it is expensive and time consuming to cast these rings onto the tubes, especially with such precision as to insure that they are laterally adjacent and thus bear on one another when assembled in a bundle. Even when the rings are cast with close tolerances, unequal expansion or contraction in adjacent tubes may move their rings out of engagement, and, if this occurs, the resulting sag in one of the tubes prevents the rings from returning to lateral alignment even when the unequal expansion and contraction is discontinued.

An object of this invention is to provide a tube bundle of this type in which the adjacent finned tubes of adjacent rows are supported by strips in such a manner as to prevent their collapse without the disadvantage of a decrease in the free area between the tubes which would result from wider or more closely spaced strips.

Another object is to provide such a tube bundle in which the strips are held in predetermined spaced locations along the lengths of these tubes.

A further object of the invention is to provide such a bundle having finned tubes which may be made in accordance with this standard manufacturing procedure, and strips which are of a construction basically similar to those heretofore used.

These and other objects are accomplished, in accordance with the illustrated embodiment of the present invention, by a tube bundle in which the fins of each tube are radially inwardly crushed to provide an annular recess having a base formed by bent-over end portions of the ends. These recesses are generally laterally aligned with one another, and a rigid strip extends between adjacent rows of tubes intermediate the ends thereof with the arcuate surfaces on its upper side fitting closely about portions of the bases of the tubes of the row above it, and the arcuate surfaces on its lower side fitting closely about portions of the bases of the tubes of the row beneath it.

The bent-over portions provide a substantially solid or continuous base which is considerably stronger than the supporting surface provided by the end edges of the fins of the prior tube bundle construction. Thus it is possible to prevent collapse of the surfaces of the fins with which the strips engage, at least beyond the extent to which they are initially crushed by the recess, so that the spacing between adjacent tubes may be maintained by thickening the strips without widening them, and in fact by even making the strips narrower than heretofore possible. Furthermore, when the strips are received in the recesses of the tubes, they limit longitudinal movement of one with respect to the other. Thus, even if the ends of the strips are free of restraint, the strips cannot migrate along the tubes, and are instead held in substantially fixed intervals along the lengths of the tubes.

In the usual bundle which may be of substantial length, there are series of strips at spaced intervals along the lengths of the tube rows, the spacing being determined by that necessary to prevent undue sag in the tubes. The strips are normally identical and made of integral one-piece members having an undulating shape to form the arcuate surfaces on its opposite sides. Preferably, the depth of each recess is greater than the spacing between adjacent fins on the tube, whereby the bent-over portions overlap and engage one another.

The tube rows of the bundle are supported by a frame in a generally horizontal position, and a lowermost strip is supported by the frame beneath the lowermost tube row with the arcuate surfaces on its upper side fitting closely about the bottom sides of the bases of the tubes of the lowermost row. The strips above the lowermost row are thus supported on the upper sides of the tube row beneath them, and in turn support the lower sides of the tubes of the tube row above them.

In the preferred and illustrated embodiment of the invention, the frame includes side members which extend along opposite sides of the tubes of the rows, and a cross member which extends laterally beneath the side members beneath the tube rows supports the lowermost strip. The frame also preferably includes another cross member which extends between the side members above the tube rows, and is received within the recesses on the upper sides of the tubes of the top row to hold the tube rows down on the lower cross member.

Vertical slots are formed on the inner sides of the side frame members to receive the ends of the strips, so as to further limit endwise movement of the strips along the tube rows within the frame. The slots are slightly larger than the strips so that the ends of the strips fit loosely within them to permit some tolerances in assembly, and also to allow for unequal expansion and contraction of the tubes.

In the drawings, wherein like reference characters are used throughout to designate like parts:

Figure 1:
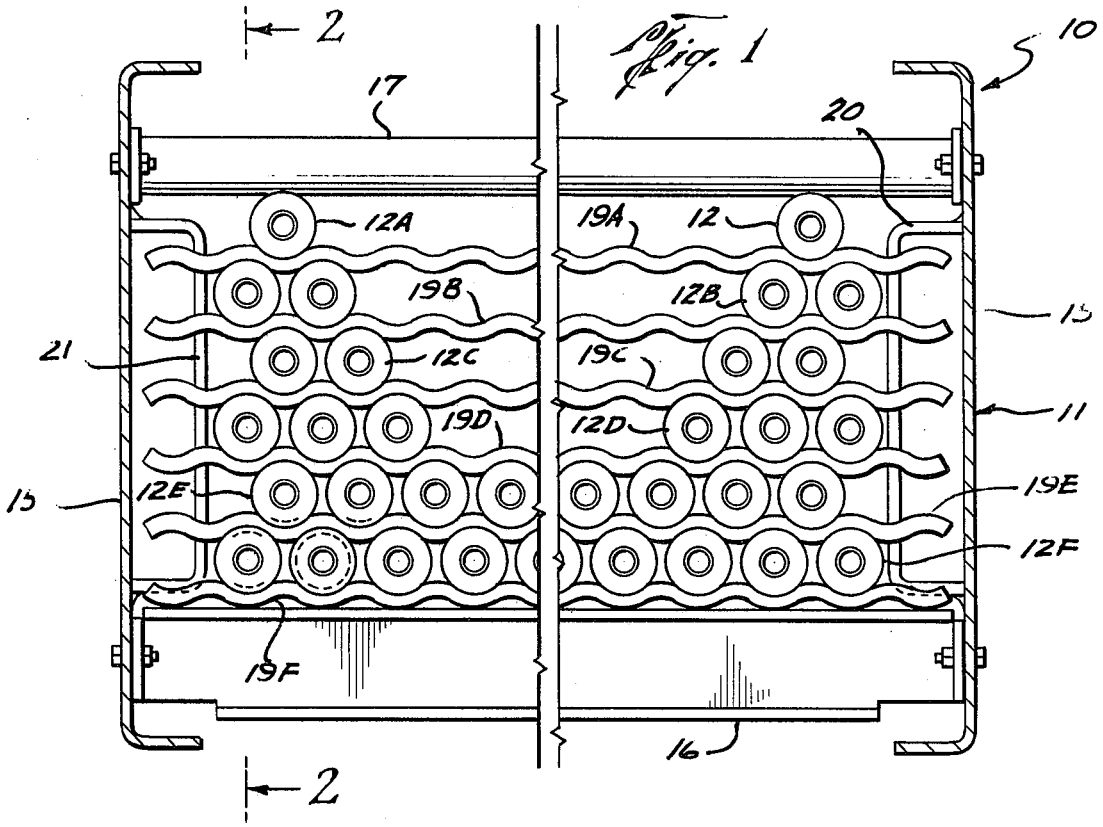
FIG. 1 is a cross-sectional view of a tube bundle constructed in accordance with the present invention, with some of the tubes removed therefrom and the bundle shown in discontinuous form across its width for purposes of illustration.
Figure 2:
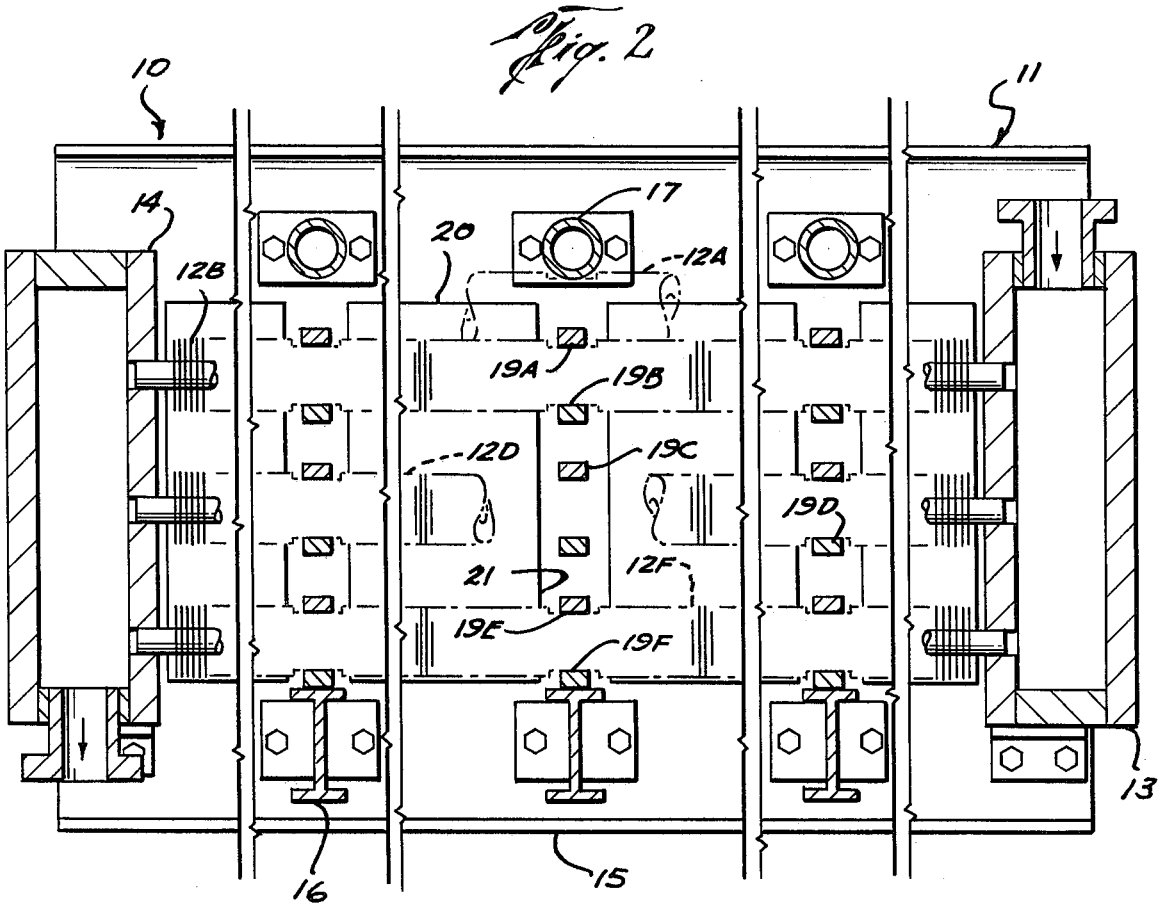
FIG. 2 is a vertical longitudinal sectional view of the tube bundle of FIG. 1, as seen along broken lines 2—2 thereof, with some of the tubes being shown in broken lines and the bundle being shown in discontinuous form along its length for purposes of illustration.
Figure 3:
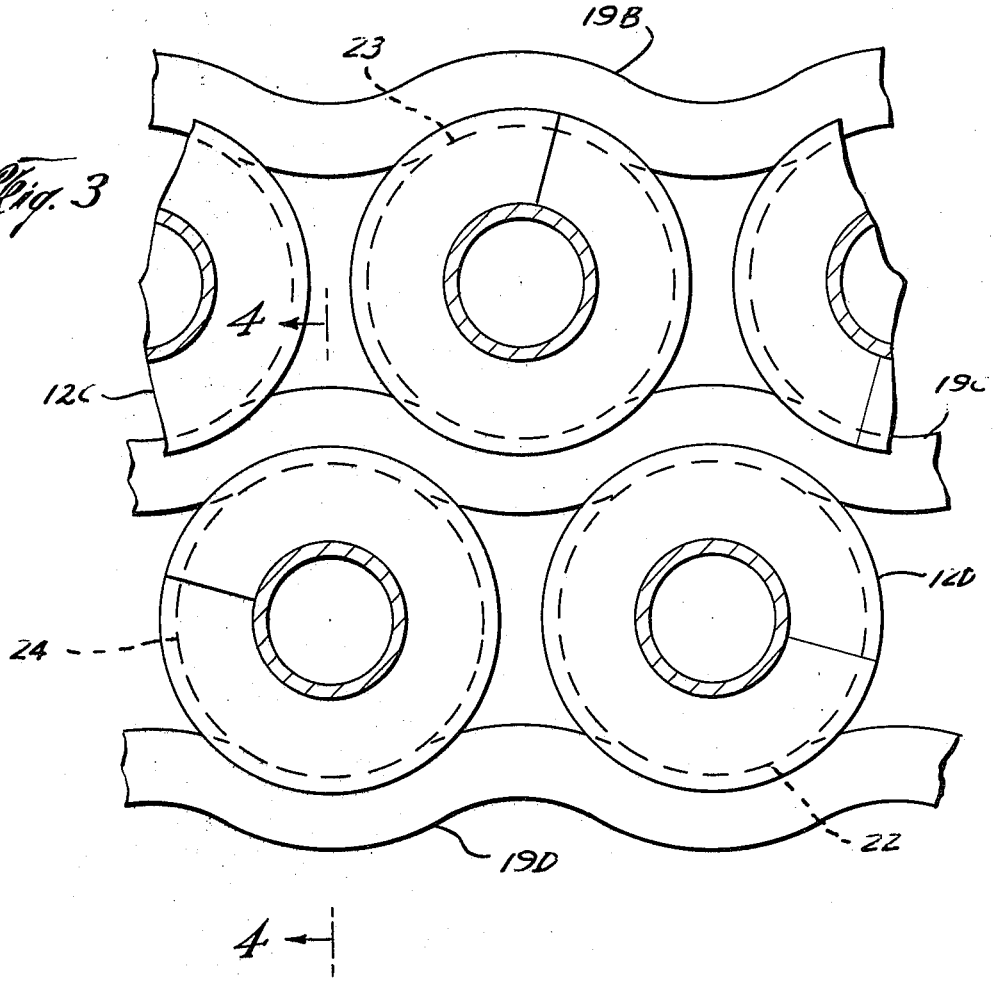
FIG. 3 is an enlarged cross-sectional view of a portion of the bundle.

With reference now to the details of the above-described drawings, the overall tube bundle, which is indicated in its entirety by reference character 10, is shown in FIGS. 1 and 2 to comprise a frame 11 in which a plurality of parallel rows of fin tubes 12 are supported. More particularly, the frame supports the parallel rows of tubes in generally horizontal positions, the successively lower rows of tubes from the upper row to the lower row being designated by reference characters 12A, 12B, 12C, 12D, 12E and 12F.

As will be described to follow, the axes of adjacent tubes in the adjacent rows are arranged and held in triangular patterns. Hence, there is a free area between these adjacent tubes through which air may be circulated in heat exchange relation with another fluid medium being circulated through the tubes. This latter medium may be introduced into one end of the tubes through an inlet member 13 and may be discharged through the other ends of the tubes through an outlet member 14.

Frame 11 includes side members 15 extending along and parallel to the tube rows at each side thereof, and cross members 16 and 17 connected to and extending between side members below and above, respectively, the tube rows. Thus, as will also be described in more detail to follow, the lowermost tube row 12F and thus the tube rows above it, are supported on the cross members 16. On the other hand, and as will also be described to follow, upper cross member 17 engages with the tubes of the uppermost row 12A so as to hold the uppermost row and the rows below it down upon lower cross member 16.

For reasons which will be apparent from the description to follow, upper cross members 17 are arranged vertically above the lower cross members 16. Also, flanges 18 are connected to the inner sides of the side members near each end thereof for supporting headers 13 and 14 in a manner to permit some longitudinal sliding of the headers with respect thereto, although as will be described to follow, longitudinal movement of the tube rows to which the headers are connected is limited. As shown in the illustrated embodiment of the invention, the side members 15 are channels, the lower cross members 16 are I beams, and the upper cross members 17 are tubular.

The tubes of each row are supported on strips 12 of metal or other rigid material, the lowermost series 19F of strips being supported on the upper side of frame cross member 16 to support the lowermost tube row 12F, and the series 19E, 19D, 19C, 19B, and 19A of strips being disposed between successively higher vertically adjacent rows of tubes. Thus, the strips of series 19E are supported on tube row 12F to support the tube row 12E above it, the strips of series 19D are supported on tube row 12E to support tube row 12D above it, the strips of series 19C are supported on tube row 12D to support tube row 12C above it, and the strips of series 19B are supported on tube row 12C to support tube row 12B above it. The strips of series 19A, on the other hand, are supported on tube row 12B to support tube row 12A beneath the lower sides of upper cross members 17.

As shown in FIG. 2, and as in the case of prior tube bundles of this type, the strips of each series are disposed vertically of corresponding strips of the other series, the vertically arranged strips being located at substantially equally spaced intervals along the lengths of the tube rows. More particularly, the strips are vertically aligned with vertically aligned pairs of upper and lower cross members, to that the spacing of the cross members determines the spacing of the strips.

As was also true of the prior tube bundle of this type, each strip is an integral one-piece member of undulating shape so as to provide alternating convex and concave arcuate surfaces along its upper and lower sides. The concave arcuate surfaces on the upper sides of the strips provide supporting surfaces which engage the lower sides of the tubes of the row above it, while the concave surfaces of all but the strips of lowermost series 19F provide surfaces which engage the upper sides of the tubes of the row beneath it. Thus, with the axes of the tubes arranged in triangular patterns, the concave and convex portions of the vertical adjacent strips are disposed vertically opposite one another to provide alternate enlarged areas between vertically adjacent strips for receiving tubes therebetween.

Channels 20 are mounted on the inner sides of side members 15 of the frame and are spaced from one another along the lengths of the side members to provide slots 21 therebetween, as best shown in FIG. 2. The ends of the strips 19 are received within the slots with a relatively loose fit which provides tolerance in the assembly of the bundle. As will be described below, since the strips themselves limit longitudinal movement of the tubes, the disposal of their ends within slots 21 limits movement of the tube row longitudinally of the frame. At the same time, the loose fit permits some differential expansion and contraction of the tubes of the bundle.

In accordance with the novel aspects of the present invention, the fins of each tube are inwardly crushed to provide an annular recess 22 thereabout having a base 23 formed by bent-over outer end portions 24 of the fins, and the strips of the series above and below the tube rows 12B, 12C, 12D, 12E and 12F are received within the recesses in the tubes above and below them, while the strips of series 12A are received in the recesses of the tubes of row 12A below them. More particularly, the arcuate concave surfaces of the strips are formed on essentially the same radius as the bases 23 of the recesses so that the arcuate surfaces on the lower sides of the strips above each tube engage with a substantial peripheral portion of the top side of the base thereof, while the upper sides of the arcuate surfaces of the strips below each tube engage with a substantial peripheral portion of the bottom side of the base thereof.

As previously described, the bent-over portions provide a substantially solid or continuous base 23 which is capable of supporting considerably more weight than the tips of the fins, and therefore will not alter the predetermined spacing between adjacent tubes by crushing them further. That is, the spacing which results from the depth of the recesses about the tubes relative to the strip thickness is maintained. The load bearing capacity of the bases of the strips is increased still further when the fins are of the type which are of increasing thickness from their tubes to their bases, as is the case when the fins are extruded from fin stock.

Figure 4:
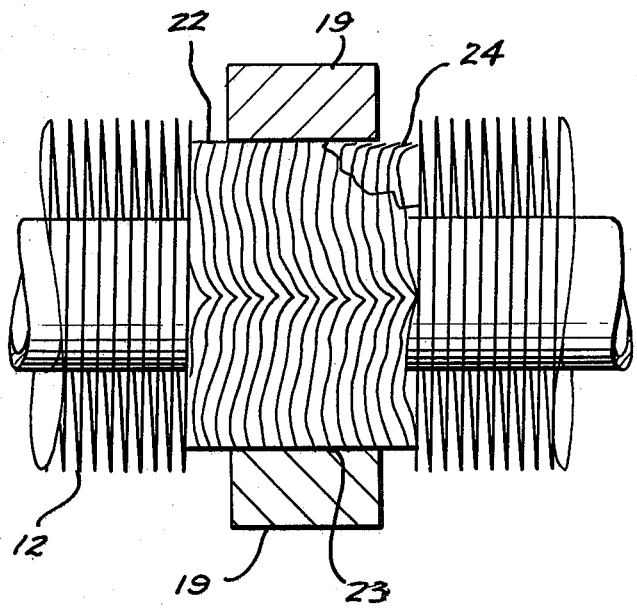
FIG. 4 is an enlarged view of a side of a recess about one of the finned tubes and rigid strips received within the upper and lower sides of the recess.

As best shown in FIG. 4, each recess is wider than the strip it receives so as to allow for some misalignment in assembly. At the same time, the uncrushed fins on opposite ends of the recess will limit lengthwise movement of each strip with respect to the tube. Consequently, even though the strip may be sufficiently flexible to permit its ends to become free of slots 21, it is prevented from moving any substantial distance along the lengths of the tube rows.

Preferably, the ends of the fins are crushed to a depth which is greater than the longitudinal spacing between adjacent fins. In this way, the bent-over ends of the fins will normally overlap one another, as shown in FIG. 4, and thereby further strengthen the support for the strips.

Typically, each of the tubes may have an outer fin diameter of 2¼ inches, with the fins thereon being spaced 3/32 of an inch apart, and the recesses 22 are formed to a depth of ⅛ of an inch so that the outer diameter of the base 23 of the recess is 2 inches. Adjacent tubes in adjacent rows have their axes arranged in equilateral triangular patterns, and the strips are ½ inch thick in order to space the axes of adjacent tubes of adjacent rows 2½ inches apart. In this case, of course, the free area in the most restrictive areas between adjacent tubes will be ¼ inch wide.

It has been found that a tube having a strip received in a recess formed in this fashion will support four times as much weight as an ordinary tube in which a strip of the same width is supported on the outer peripheral edges of the fin tubes, as in the prior bundle of this type. Consequently, a strip 12 of one half the width of the prior strip, and thus decreasing the obstruction to free flow area by one half, will be supported with twice the usual strength.

With a strip one inch wide, the recess may be 1¼ to 1½ inches wide. Although the number of strips in each series necessary to provide the desired support along the lengths of the tube rows will depend on the lengths of the tubes, tubes of the size above described require that the strips be at intervals no less than 4 to 6 feet to prevent undue sag.

This invention further contemplates that the tubes may initially be manufactured in accordance with standard procedures, such as by extrusion of the fins on a length of fin stock. Then, the recesses may be formed by crushing the desired lengths of fins with suitable apparatus.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A tube bundle, comprising a plurality of parallel rows of finned tubes, the axes of adjacent tubes in adjacent rows being arranged in triangular patterns, headers fixedly connected to the opposite ends of the tube, a portion of the fins of each tube being radially inwardly crushed to provide an annular recess between adjacent uncrushed fins having a base formed by bent-over outer end portions of the fins, said recesses being generally laterally aligned with one another, and a rigid strip extending between adjacent rows of tubes intermediate the ends thereof, each strip having arcuate surfaces on one side thereof which fit closely about portions of the bases of the tubes of one adjacent row and arcuate surfaces on the other side thereof which fit closely about portions of the bases of the tubes of the other adjacent row.

2. A tube bundle of the character defined in claim 1, wherein there are series of said strips at spaced locations along the lengths of the tube rows.

3. A tube bundle of the character defined in claim 1, wherein all strips are identical.

4. A tube bundle of the character defined in claim 1, wherein the depth of each recess is greater than spacing between adjacent fins.

5. A tube bundle, comprising a plurality of parallel rows of finned tubes, the axes of adjacent tubes in adjacent rows being arranged in triangular patterns, headers fixedly connected to the opposite ends of the tube, means for supporting said rows of tubes in a generally horizontal position, a portion of the fins of each tube being radially inwardly crushed to provide an annular recess between adjacent uncrushed fins having a base formed by bent-over outer end portions of the fins, said recesses being generally laterally aligned with one another, and a series of relatively rigid strips each extending laterally beneath a row of tubes intermediate the ends thereof, the lowermost strip being supported by said supporting means and having arcuate surfaces on its upper side which fit closely about the bottom sides of the bases of the tubes of the lowermost row, and the strips above the lowermost strip having arcuate surfaces on their lower sides which fit closely about the top sides of the bases of the tubes of the row beneath them and arcuate surfaces on their upper sides which fit closely about the bottom sides of the bases of the tubes of the row above them.

6. A tube bundle of the character defined in claim 5, wherein said supporting means has vertical slots in which the ends of the strips are loosely received.

7. A tube bundle of the character defined in claim 5, wherein there are series of said strips at spaced locations along the lengths of the tube rows.

8. A tube bundle of the character defined in claim 5, wherein all strips are identical.

9. A tube bundle of the character defined in claim 5, wherein the depth of each recess is greater than spacing between adjacent fins.

10. A tube bundle, comprising a plurality of parallel rows of finned tubes, the axes of adjacent tubes in adjacent rows being arranged in triangular patterns, headers fixedly connected to the opposite ends of the tube, a frame for supporting said rows of tubes in a generally horizontal position, said frame including side members extending along opposite sides of the rows of tubes and a cross member extending laterally between the side members beneath the tube rows, a portion of the fins of each tube being radially inwardly crushed to provide an annular recess between adjacent uncrushed fins having a base formed by bent-over outer end portions of the fins, said recesses being generally laterally aligned with one another, and a series of relatively rigid strips each extending laterally beneath a row of tubes intermediate the ends thereof, the lowermost strip being supported by said cross member and having arcuate surfaces on its upper side which fit closely about the bottom sides of the bases of the tubes of the lowermost row, and the strips above the lowermost strip having arcuate surfaces on their lower sides which fit closely about the top sides of the bases of the tubes of the row beneath them and arcuate surfaces on their upper sides which fit closely about the bottom sides of the bases of the tubes of the row above them.

11. A tube bundle of the character defined in claim 10, wherein there are a plurality of series of said strips at spaced locations along the lengths of the tube rows.

12. A tube bundle of the character defined in claim 10, wherein all strips are identical.

13. A tube bundle of the character defined in claim 10, wherein the strips are integral one-piece members of undulating shape.

14. A tube bundle of the character defined in claim 10, wherein the frame includes another cross member extending between the side members above the tube rows, said upper cross member being received in the recesses on the upper sides of the tubes of the top row.

15. A tube bundle of the character defined in claim 10, wherein the depth of each recess is greater than spacing between adjacent fins.

16. A tube bundle of the character defined in claim 10, wherein there are vertical slots on the inner sides of said side frame members in which the ends of the strips are received.

17. A tube bundle of the character defined in claim 16, wherein the slots are slightly wider than the strips.

* * * * *